United States Patent [19]

Isenberg

[11] 4,447,204

[45] May 8, 1984

[54] COMBUSTION CONTROL WITH FLAMES

[75] Inventor: Arnold O. Isenberg, Pittsburgh, Pa.

[73] Assignee: Westinghouse Electric Corp., Pittsburgh, Pa.

[21] Appl. No.: 387,295

[22] Filed: Jun. 10, 1982

[51] Int. Cl.[3] ..... F23N 5/00

[52] U.S. Cl. ..... 431/76; 204/424; 204/427; 422/62; 422/90; 422/98; 436/55; 436/153

[58] Field of Search ..... 431/75, 76, 25, 175; 236/15 E; 204/1 S, 424–429; 422/54, 62, 90, 98; 436/55, 153; 340/579

[56] References Cited

U.S. PATENT DOCUMENTS

| | | | |
|---|---|---|---|
| 2,437,720 | 3/1948 | Ackley | 436/136 |
| 2,622,967 | 12/1952 | Lobosco | 431/76 |
| 3,302,685 | 2/1967 | Ono et al. | 431/25 |
| 3,718,430 | 2/1973 | Fischer et al. | 422/54 |
| 4,014,777 | 3/1977 | Brown | 431/354 |
| 4,125,356 | 11/1978 | Ohashi et al. | 431/76 |
| 4,140,475 | 2/1979 | Wolfe | 431/42 |

FOREIGN PATENT DOCUMENTS

| | | | |
|---|---|---|---|
| 1418095 | 10/1965 | France | 431/25 |

*Primary Examiner*—Lee E. Barrett

*Attorney, Agent, or Firm*—T. R. Trempus

[57] ABSTRACT

A combustion control process and apparatus provides a reference flame of known or constant composition which is in ionic communication with the main flame which is to be controlled. Both the reference and main flames are supported by electrically insulated burner nozzles and the flames are in mutual electrical communication through ionized gases. The potential difference is measured between the flames by way of the nozzles and is used in the air-fuel ratio adjustment of the main burner. Additionally, the main burner can function as a reference point in combination with a zirconia oxygen sensor to ascertain potential differences therebetween, which differences reflect the air-fuel mixture of the main flame.

5 Claims, 2 Drawing Figures

COMBUSTION CONTROL WITH FLAMES

BACKGROUND OF THE INVENTION

1. Field of the Invention

The invention is directed to a process and an apparatus for combustion control. More particularly, it is directed to the measurement of the potential difference between one flame of known composition and a second flame of unknown combustion in order to ascertain the oxygen activity in flames which are in over-ventilated or under-ventilated conditions.

2. Description of the Prior Art

The efficient control of combustion processes is a critical consideration in, for example, power generation, process heating, residential heating and internal combustion engines. Fast and efficient combustion control provides substantial savings in fuel consumption as well as possibly significant improvements to the air quality of exhaust generated by the aforementioned processes. One of the earliest, as well as simplest methods of combustion control consisted of accurately mixing premeasured quantities of fuel and air in order to establish and maintain a desirable air-fuel ratio. This method, however, is unreliable when controlling large burners and requires the analysis of the resulting combustion products and often the correction of the air or fuel supply to achieve the correct composition. Combustion analysis is often accomplished through the use of electrochemical sensors which deliver a voltage signal that is exponential in response. Usually, one sensor electrode is exposed to a known oxygen concentration and the other electrode is exposed to the combustion products. Additionally, the sensor must be heated to a constant or known temperature, usually above 500° C. in order to obtain an accurate calculation of the unknown oxygen concentration. Because such sensors are made of zirconia ceramics, sudden heat-up can result in heat-shock destruction of the brittle ceramic and instrument failure. In a large preheat furnace, for example, the temperature upon start-up rises slowly to the level at which the ceramic sensor will function properly. Thus, for all practicable purposes, there is little or no combustion control until the sensor reaches operating temperatures.

It is an object of this invention to provide reliable and accurate combustion control which is virtually instantaneous with the start-up of combustion.

It is a further object of this invention to provide a combustion-control means which can also function as a pilot flame.

It is yet another object of this invention to provide a combustion control "reference flame" which can be used in combination with zirconia oxygen sensors.

SUMMARY OF THE INVENTION

According to the invention, a process and an apparatus for the control of a combustion process utilizes a reference flame fed by a nozzle which is electrically insulated from the nozzle of the main burner over which control is desired. The reference flame is of a predetermined constant composition, that is, it is generated by an ascertained air-fuel mixture, and the flame renders products of combustion with a constant oxygen content or an absence of oxygen. The reference flame is in electrical communication with the main burner's flame through ionized combustion gases. The potential difference between the reference flame nozzle and the main burner is measured by an indicating device such as a volt-meter. It has been determined experimentally that a zero potential difference measured therebetween indicates that the oxygen content of the main burner is substantially similar to the oxygen content of the reference flame. Accordingly, any modification of the air-fuel mixture of the main burner resulting in a change of the oxygen content in the products of combustion is reflected in the measured potential difference. This difference can be either positive or negative depending upon whether or not the main burner is rich or lean when compared to the reference flame. Moreover, in a calibrated system in which specific differences have been identified with specific main burner combustion conditions, the measured potential provides an instant readout of main burner status.

BRIEF DESCRIPTION OF THE DRAWINGS

The above as well as other features and advantages of this invention will become apparent through consideration of the detailed description in connection with the accompanying drawings in which.

DESCRIPTION OF THE PREFERRED EMBODIMENT

It should be readily understood by those skilled in the art of combustion control that the principles of the apparatus and process disclosed herein can be readily adapted to a variety of uses in which reliable and accurate combustion control is desired, without departing from the spirit and scope of my invention as defined in the appended claims.

Figure 1:
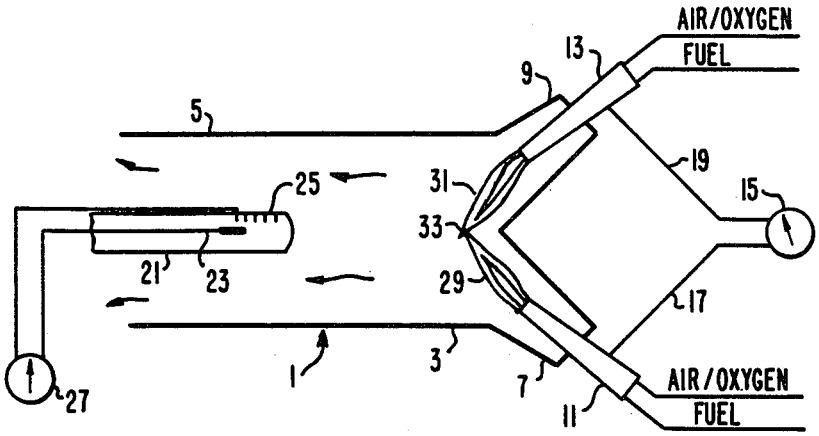
FIG. 1 illustrates schematically a section through a combustion duct demonstrating the principles of this invention.

When flames of different composition are in contact with each other a potential difference is impressed onto their respective burner nozzles when the respective nozzles consist of an electrically conductive material and are electrically insulated from each other. This potential difference between burner nozzles can be measured with a voltmeter. Turning now to FIG. 1, the principles of this invention are schematically illustrated by a combustion duct. The description of the instant invention in association with a combustion duct is done for illustrative purposes only and should not be viewed as in any way limiting the invention to use only with such a duct arrangement. The combustion duct generally indicated by the reference character 1 consists of a body portion 3 with an open exhaust escape 5 at one end and a pair of angularly disposed burner nozzle seats 7 and 9 at the opposite end. A reference flame burner nozzle 11 is mounted in seat 7 and a main flame burner nozzle 13 is mounted in seat 9. The nozzles 11 and 13, which are made of electrically conductive material, are electrically insulated from each other and the body portion 3 by means of a suitable insulator, i.e., refractory material or the like. While this invention will be described throughout as utilizing a first flame as a reference flame and a second flame as the main burner flame to be controlled by the process and apparatus of this invention, it is possible to utilize a single reference flame to control two or more main burner flames in ionic communication therewith.

The nozzles 11 and 13 are in electrical communication with an indicating means such as voltmeter 15 through electrical leads 17 and 19 respectively. An independent means 21 for the measurement of the oxygen content of the exhaust gas is mounted near the exhaust end 5 of the combustion duct 1. The independent means 21, such as a zirconia ceramic sensor, has one sensor electrode 23 exposed to a known oxygen concentration and the other electrode 25 exposed to the combustion products within the combustion duct 1. The electrodes of the zirconia ceramic sensor 21 are connected to a second voltmeter 27.

Utilizing the above described combustion duct 1, the following experiments were conducted in order to illustrate the process of this invention. First, a reference flame 29 was ignited and after allowing the zirconia sensor 21 to reach operational temperature, about 800° C., the oxygen concentration of the exhaust gas (indicated by the arrows) was measured. Voltmeter 27 indicated 45 mV which converted to approximately 3% excess oxygen in the combustion product. With a constant air-fuel mixture being fed into burner 11, the main flame 31 of burner 13 was ignited. With the mantle of each flame touching as at 33, a potential difference between nozzles 11 and 13 was measured at several hundred millivolts by voltmeter 15. The zirconia sensor 21 likewise detected an increased potential of nearly 700 mV as indicated by voltmeter 27. This reading indicated that excess fuel was present in the combined combustion gas flow.

The air-fuel mixture being supplied to burner 13 was adjusted to increase the flow of oxygen to flame 31 until the voltmeter 27 of the zirconia sensor indicated 45 mV. As the reading of sensor voltmeter 27 approached 45 mV, the voltmeter 15 measuring the potential difference between burners 11 and 13, reflected a decreasing potential difference until a zero potential difference was indicated. Having established a constant air-fuel flow to burner 13, both voltmeters show stable voltage readings.

The reference flame 29 was extinguished in order to ascertain the oxygen content of the combustion products of main flame 31. The zirconia sensor-voltmeter 27 showed an unchanged reading of 45 mV. The voltmeter 15 at this point read a meaningless floating potential. These results indicate that as soon as the potential difference between the reference flame 29 and the main flame 31 is adjusted to zero volts as reflected by the voltmeter 15, the oxygen activities in the combustion products of the two flames are identical. Moreover, it was observed that in conditions in which the mantles of the flames were in contact with each other and the burners show about a zero voltage difference therebetween, the flames have a nearly identical mantle pattern, core pattern and color. (The nozzles used in this observation were identical.) Voltages at least as high as 3 volts have been measured between the nozzles and reversal of polarity can be achieved when flame conditions are reversed from one to the other burner. That is to say, when one burner is rich or lean in comparison with the other burner and this relative condition is reversed, polarity reversal occurs.

Figure 2:
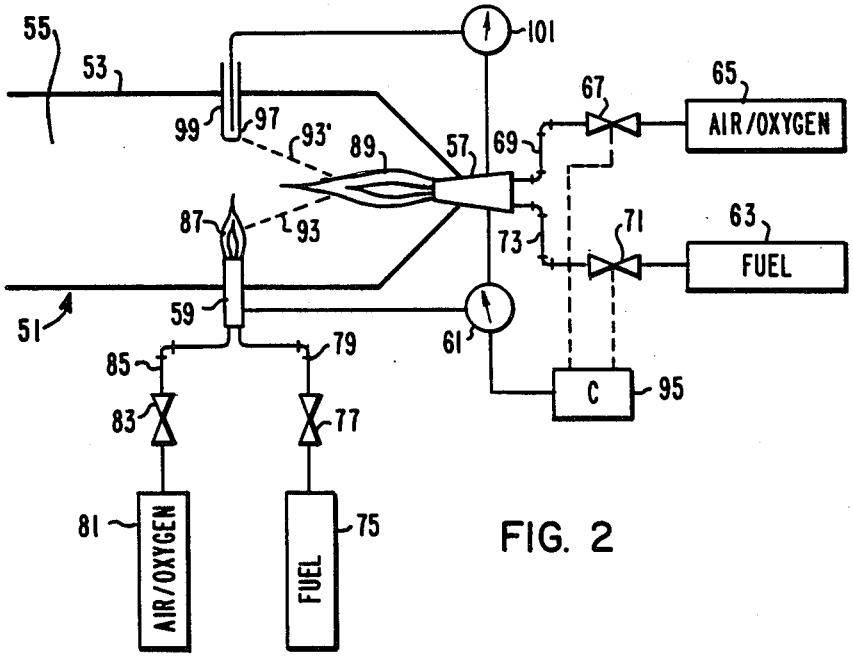
FIG. 2 is a schematic illustration of a combustion control apparatus incorporating the principles of this invention.

Turning now to FIG. 2, an application of the process and apparatus of this invention is illustrated in a combustion control system generally indicated by the reference character 51 having a combustion housing portion 53 with an exhaust end 55. At the opposite end of the body portion 53, at least one main burner means 57 is mounted so as to be electrically insulated from the reference flame nozzle means 59. These electrically conductive nozzles are electrically insulated so that the potential difference therebetween can be measured by an indicating means such as voltmeter 61 which is in electrical communication with both nozzles. Main burner 57 is associated with flame generation means consisting of fuel and air/oxygen supply means 63 and 65 respectively. Fuel is provided to the burner 57 through control valve adjusting means 67 and line 69 while the air passes through control valve adjusting means 71 and line 73. Likewise, the reference flame nozzle is provided with fuel from supply means 75 through control valve 77 and line 79 and with air or oxygen from supply means 81 through control valve 83 and line 85.

The reference flame nozzle means 59 can be configured to serve as a pilot flame for the main flame ignition. Suitable fuels for the reference flame 87 include carbon monoxide, hydrogen, methane, propane and butane. Since only a small reference flame is required, it is relatively easy to accurately measure the limited flows of fuel and air to the burner nozzle 59. One method of providing combustive agents for the reference flame consists of employing a water electrolysis cell which produces gases such as oxygen and hydrogen in stoichiometric porportions. In such a simple reference flame, the gas supply is safe, inexpensive and reliable.

If, for example, the amount of oxygen supplied to the reference burner 57 is sufficient to meet the stoichiometric requirements for the complete and efficient reaction of the fuel provided thereto, a known combustion product would be generated by the reference flame 87. Once the main flame 89 is ignited, a gaseous ionic path as at 93 is established between the main and reference flames. The potential difference between the main burner nozzle 57 and the reference flame burner nozzle 59 is measured by the voltmeter 61. Suitable control means 95 can be utilized to effect the modification of the air-fuel mixture of main burner 57. The control means 95 is in communication with the voltmeter 61 and may include amplification and signal processing capabilities. The control means 95 is also in electromechanical communication with control valves 67 and 71 through which valves the air-fuel mixture of the main burner is adjusted. In this manner, the air-fuel ratio of the main burner 57 is adjusted until a predetermined potential difference is established between the main burner 57 and the reference burner 59.

As described above, the measurement of differential flame potentials via burner nozzles is possible because flames consist of gases that become partially ionized. Ionization makes it possible to interface flames with other ionized materials such as zirconia solid state electrolytes. As also shown in FIG. 2, a gaseous ionic path 93' is established between the main flame 89 and the inside, zirconia solid electrolyte 97 of the sensor 99. An indicating means, such as voltmeter 101, measures the potential difference between the sensor 99 and the main burner 57. This measurement can serve to control the combustion process through associated controlling equipment as described in connection with the voltmeter 61. This control can be effected either alone or in combination with the reference flame 87. Because gas ionization is complex, and the main burner 57 is not a true sensing electrode, the measured potentials are not necessarily those of an oxygen concentration cell. However, as the air-fuel mixture passes through stoichiometric balance going from lean to rich and vice-versa, the potential changes are significant. Such a sensing arrangement is most practicable for use in situations in which the sensing electrodes on such zirconia sensors are subject to erosion or contaminants because no external electrodes need be applied to the zirconia sensor. A zirconia sensor does require a period of preheating to an operational temperature, usually over 500° C., before accurate measurements can be taken. Conversely, the reference flame has an instantaneous response and can also be utilized as a pilot light to ignite the main burner.

What has been described is a process and an apparatus which utilizes a combination of flames with either a reference flame and/or an ionized solid sensor together with electrically conductive burner structures to effect combustion control.

What is claimed is:

1. A process for detecting the relative oxygen content of the combustion products from a flame fed by an undetermined air-fuel ratio comprising the steps of:

(a) providing an electrically insulated first nozzle means for the generation of said flame being fed by an undetermined air-fuel ratio, said flame consisting in part of ionized gases and said nozzle means being electrically conductive;

(b) establishing an ionic interface between the ionized gases of said flame and a second electrically insulated source of oxygen ion conductive material;

(c) measuring the potential difference between said electrically insulated first nozzle means and said second electrically isolated source of oxygen ion conductive material, said potential difference reflecting changes in the combustion condition of said flame, that is, lean to rich and rich to lean combustion conditions.

2. The combustion control process of claim 1 wherein the insulated source of oxygen ion conductive material is a zirconia solid state electrolyte.

3. A combustion control apparatus comprising:

a combustion housing means; a first nozzle means mounted in said housing means and electrically insulated therefrom; at least one other nozzle means mounted in said housing means and electrically insulated therefrom; means to generate a reference flame of a predetermined air-fuel composition from said first nozzle means, said reference flame having combustion products of a known or constant composition and consisting in part of ionized gases; means to generate at least a second flame from said at least one other nozzle means, said second flame rendering combustion products, said second flame combustion products being in electrical communication through an ionic interface with said combustion products of said reference flame; a first indicating means in electrical communication with said first nozzle means and said at least one other nozzle means, said indicating means reflecting the potential difference therebetween; an electrically insulated source of oxygen ion conductive material in ionic communication with at least said second flame and a second indicating means in electrical communication with said oxygen ion conductive material and said second nozzle means, said second indicating means reflecting the potential difference therebetween, wherein said potential difference reflected by said first indicating means indicates the oxygen content of the combustion products of said second flame relative to said combustion products of said reference flame and said potential difference reflected by said second indicating means reflects changes in the combustion condition of said second flame, that is, lean-to-rich and rich-to-lean combustion conditions.

4. The combustion control apparatus of claim 3 wherein the electrically insulated source of oxygen ion conductive material is a zirconia solid state electrolyte.

5. The combustion control apparatus of claim 3 including an electrolysis cell for the production of gases in stoichiometric proportions, said cell providing the predetermined air-fuel composition of the reference flame.

* * * * *